US011014225B2

(12) United States Patent
Garcia Miro Peschiera

(10) Patent No.: US 11,014,225 B2
(45) Date of Patent: May 25, 2021

(54) WORKBENCH FOR THE COLD INTERVENTION, FOLDING, BENDING, TWISTING OR DEFORMATION OF METAL PLATES OR SHEETS

(71) Applicant: Alfonso Garcia Miro Peschiera, Lima (PE)

(72) Inventor: Alfonso Garcia Miro Peschiera, Lima (PE)

( * ) Notice: Subject to any disclaimer, the term of this patent is extended or adjusted under 35 U.S.C. 154(b) by 148 days.

(21) Appl. No.: 16/495,524

(22) PCT Filed: Dec. 15, 2017

(86) PCT No.: PCT/PE2017/000031
§ 371 (c)(1),
(2) Date: Sep. 19, 2019

(87) PCT Pub. No.: WO2019/117734
PCT Pub. Date: Jun. 20, 2019

(65) Prior Publication Data
US 2020/0016735 A1 Jan. 16, 2020

(51) Int. Cl.
*B25H 1/02* (2006.01)
*B21D 5/16* (2006.01)

(52) U.S. Cl.
CPC ..... *B25H 1/02* (2013.01); *B21D 5/16* (2013.01)

(58) Field of Classification Search
CPC .... B25H 1/08; B25H 1/10; B25H 1/02; Y10T 29/53996; Y10T 29/5369; B21D 43/12; B21D 11/20; B21D 11/22; B21D 7/10; B66C 1/16; B66C 1/12
See application file for complete search history.

(56) References Cited

U.S. PATENT DOCUMENTS 1,285,628 A * 11/1918 Craley ..... F16C 29/02 384/39
3,212,457 A * 10/1965 Looker ..... B60P 7/0815 410/105
4,930,333 A * 6/1990 Marbury ..... B21D 1/12 72/447

FOREIGN PATENT DOCUMENTS

DE 20 03 614 A1 8/1971
FR 2 231 443 A1 12/1974

OTHER PUBLICATIONS

ISR for International Application PCT/PE2017/000031.
Written Opinion for International Application PCT/PE2017/000031.
FR 2 231 443 A1 _ Espacenet English Abstract.

* cited by examiner

*Primary Examiner* — Tyrone V Hall, Jr.
(74) *Attorney, Agent, or Firm* — Ladas & Parry LLP

(57) ABSTRACT

The present invention relates to a workbench, and respective operating and manufacturing methods, for the cold intervention, folding, bending or deformation of metal plates or sheets, the constructive and functional features of which provide a solution to achieve an optimal balance between power and flexibility, such that it allows performing custom works on metal plates or sheets under power conditions that exceed human capacity. In that sense, the workbench provides a work area with multiple actuation and power options, constituting a plethora of possible combinations for the intervention, folding, bending, twisting or deformation of metal sheets of different shapes.

36 Claims, 9 Drawing Sheets

WORKBENCH FOR THE COLD INTERVENTION, FOLDING, BENDING, TWISTING OR DEFORMATION OF METAL PLATES OR SHEETS

RELATED APPLICATION

This application is a national phase entry under 35 USC 371 of international Patent Application No.: PCT/PE2017/000031 filed on 15 Dec. 2017, the disclosures of which are incorporated, in their entirety by reference herein.

TECHNICAL FIELD

The present invention is comprised within the technological sector of apparatus for working on metal plates or sheets, particularly for cold working on said material.

PRIOR ART

There are generally two methods for working (modifying) metal parts, i.e., hot and cold working. Cold working is carried out by providing the metal part with a work moment exceeding its yield strength at a normal temperature, whereas in hot working, the work moment on the metal part is achieved by means of heating said part to a temperature which induces its plastic deformation. The method chosen in each case will depend on the characteristics of the metal part, the type of work to be performed, the available equipment, the production amount, the production cost, among others.

In terms of cold working, this type of work is basically limited by the amount and type of stress to which a metal part must be subjected in order to modify it according to a specific requirement. In relation to said limitations, some equipment or apparatus have been developed to make this work easier; in this sense, for example, Chinese patent application CN103861901A describes an apparatus for manufacturing circular frames for manholes, wherein said apparatus comprises a rigid plate coupled to one of the ends of the metal part to be deformed, a semicircular deflecting surface, and two fixed points with respective pulleys for applying force on the rigid plate, such that the metal part is bent when it comes into contact with the deflecting surface to form the circular frame. However, said apparatus is only intended for manufacturing a specific type of product (circular frames for manholes of a specific dimension) from a specific type of raw material (metal baffles or tubes); likewise, some of its components are limited only to force transmission, without obtaining any mechanical advantage in the use thereof, so the stress that is applied still constitutes a limitation.

On the other hand, US patent application US20140000336A1 describes a machine for cold forming metal sheets by bending, wherein said machine comprises a first tool on which the metal plate must be bent, and a second tool placed opposite the first tool. Both tools are movable towards one another, allowing the metal part to be received in the space existing between them. Furthermore, the machine comprises a third two-part tool, each part being placed on one side of the second tool; said tool being capable of moving linearly in relation to the first and second tool. Finally, the bending of the metal sheet is obtained by means of the movement of the three tools. Nevertheless, although this patent document does not provide any information about the constructive details of the machine, the power and movement requirements indicate an industrial-type machine.

Accordingly, when cold working of metal plates or sheets is required, there are two options; the first option involves manual working on said material, with the subsequent limitations of human effort, whereas the second option involves resorting to industrial or semi-industrial workshops with specialized machinery for high power-output and/or large-scale works, significantly limiting the possibilities of intervening on the metal in individual parts, either due to the cost or the configuration of the machinery.

In that sense, there is a need to explore other alternatives which allow multiple options for cold working on metal plates or sheets that exceed the upper limits of the effort of human capacity and in contrast with the complexity and cost of the large-scale work performed in workshops.

GENERAL DESCRIPTION

The general objective of the present invention is to provide a workbench for the cold intervention, folding, bending or deformation of metal plates or sheets, the constructive and functional features of which provide a solution to achieve an optimal balance between power and flexibility, such that it allows performing custom works on metal plates or sheets under power conditions that exceed human capacity.

In this sense, one of the specific objectives consists of providing a workbench for the cold intervention, folding, bending, twisting or deformation of metal sheets, wherein the workbench comprises a benchtop with a plurality of channels for receiving a metal sheet; a cord for acting on the metal sheet through a power point fixed in said metal sheet; tension adjustment means for pulling or releasing the cord, where one of the ends of the cord is coupled to said tension adjustment means; and force transmission means through which the cord passes to obtain a mechanical advantage, according to the tension applied to the cord by the tension adjustment means, where the tension adjustment means and the force transmission means are arranged on the benchtop. Likewise, the channel of the plurality of channels of the benchtop for receiving the metal sheet, the force transmission means, and the position of the power point fixed in the metal sheet and of the tension adjustment means on the benchtop are selected according to an angle of actuation and/or a desired mechanical advantage.

Another specific objective of the present invention is to provide a method for the cold intervention, folding, bending, twisting or deformation of metal sheets, wherein the method comprises the steps of:

- selecting a channel of a benchtop comprising a plurality of channels for placing a metal sheet, according to a desired angle of actuation, where the benchtop is part of a workbench;
- placing the metal sheet on the selected channel;
- fixing a power point on the metal sheet, according to a desired angle of actuation;
- providing a cord for acting on the metal sheet through the fixed power point;
- passing the cord through force transmission means suitably arranged on the benchtop, according to an angle of actuation and a desired mechanical advantage;
- coupling one of the ends of the cord to tension adjustment means suitably arranged on the benchtop, according to an angle of actuation and a desired mechanical advantage;

applying tension to the cord through said tension adjustment means until achieving the desired result.

Finally, another specific objective of the present invention is to provide a method of manufacturing a workbench for the cold intervention, folding, bending, twisting or deformation of metal sheets, wherein the method comprises the steps of:

- providing a box, with side walls and a lower base, made of a material suitable for making a formwork, the internal dimensions of which coincide with the external dimensions of the workbench to be manufactured;
- providing a perimetral metal frame for the workbench and coupling metal profiles to said frame for forming a plurality of channels, such that a metal structure is formed;
- placing the formed metal structure inside the provided box, such that the metal structure is in contact with the lower base of the box;
- providing a mesh formed by metal rods, having dimensions equal to or smaller than the internal dimensions of the box;
- placing the provided mesh inside the box, on top of the metal structure;
- pouring concrete into the box until reaching a desired level, to then leave the concrete to dry until it hardens, such that a benchtop is formed;
- taking the benchtop out of the box, to then place it in a position in which the metal structure is visible;
- removing the hardened concrete from the plurality of channels of the benchtop and completing the channels from end to end by means of cutting the metal profiles;
- arranging tension adjustment means and force transmission means on the benchtop;
- providing a cord that works together with the tension adjustment means and the force transmission means to act on a metal sheet through a power point fixed in said metal sheet.

It must be pointed out that the workbench and the respective methods have been particularly conceived to provide a work area with multiple actuation and power options, constituting a plethora of possible combinations for the intervention, folding, bending, twisting or deformation of metal sheets of different shapes.

BRIEF DESCRIPTION OF THE DRAWINGS

To better understand the preceding description, drawings in which a practical embodiment is schematically depicted only by way of non-limiting example are attached.

DETAILED DESCRIPTION

Details of at least one embodiment of the present invention are disclosed in this section; however, it must be understood that said embodiment is merely illustrative, since the invention can be carried out in different ways. Therefore, the specific details disclosed in this section must not be interpreted as limiting, but rather more as a basis for the claims and as a representative basis for teaching a person skilled in the art how to implement the present invention.

Figure 1:
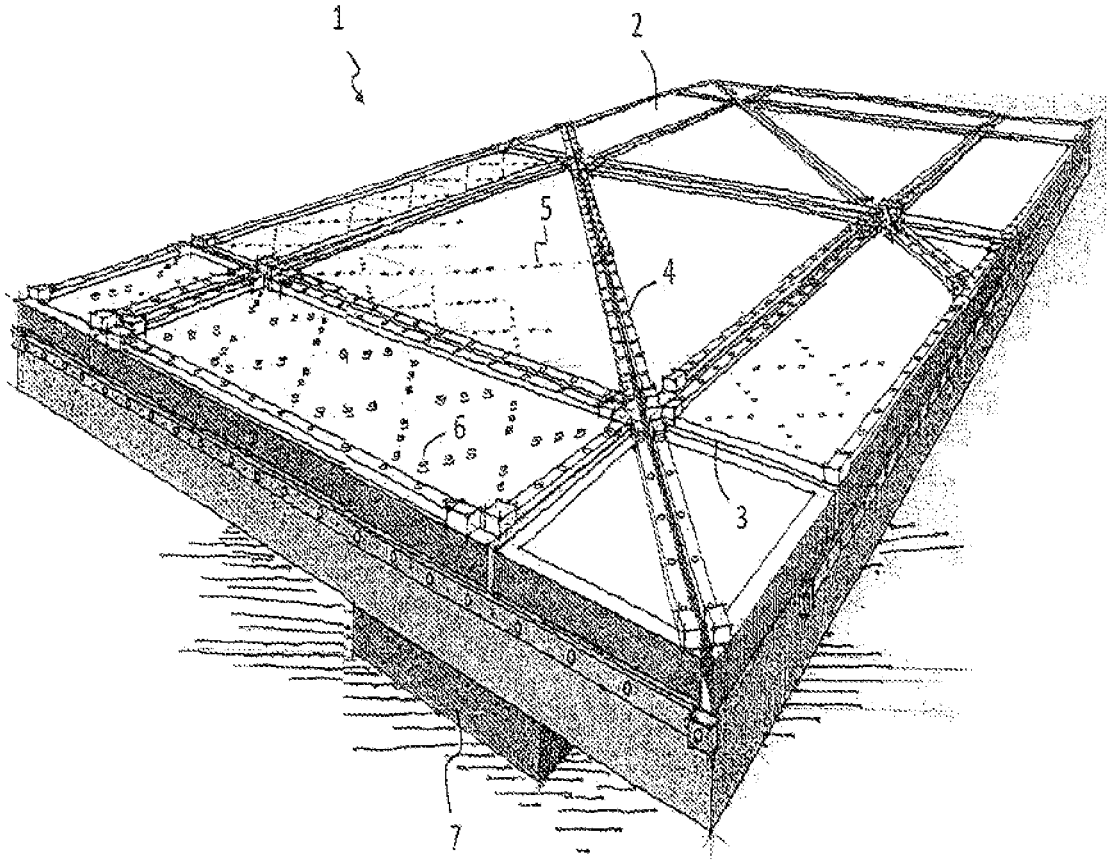
FIG. 1 shows an isometric view of a workbench for the cold intervention, folding, bending, twisting or deformation of metal sheets, according to an embodiment of the present invention, partially assembled.
Figure 3:
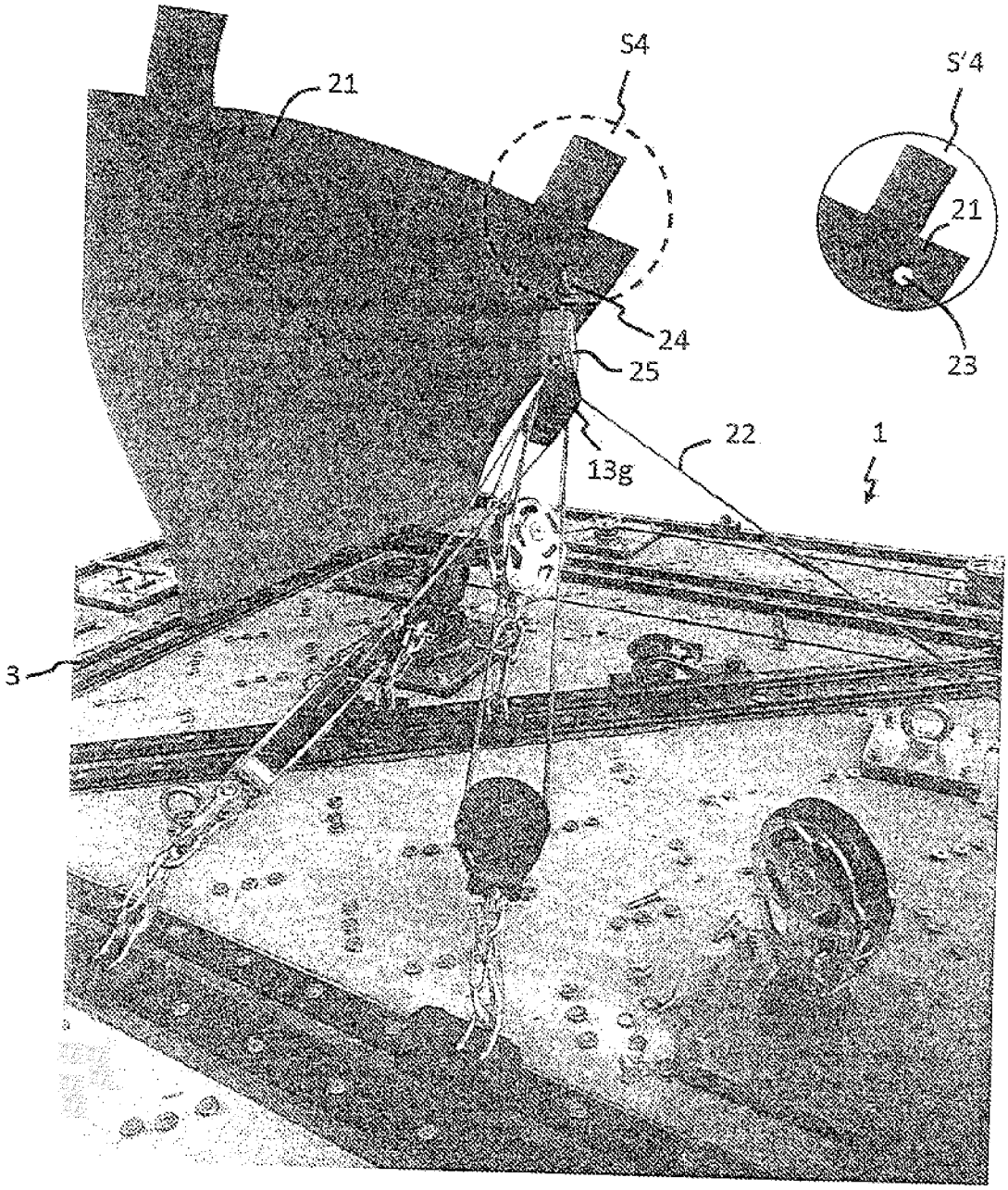
FIG. 3 shows an isometric view of a metal sheet that is being modified on a workbench for the cold intervention, folding, bending, twisting or deformation of metal sheets, according to an embodiment of the present invention.

As can be seen in FIG. 1, a workbench 1 for the cold intervention, folding, bending, twisting or deformation of metal sheets comprises a benchtop 2 with a plurality of channels 3 for receiving a metal sheet 21 (FIG. 3). In this embodiment, the benchtop 2 is a rectangular benchtop; however, in other embodiments the benchtop can adopt the shape of any regular or irregular polygon, without this departing from the scope of the invention. Furthermore, the workbench 1 comprises a plurality of rails 4 arranged on the benchtop 2; however, it must be understood that depending on the implementation, said amount may range from one to more rails. Likewise, the benchtop 2 has a plurality of holes 5 to allow the installation of interchangeable components on the benchtop 2. Said holes 5 are covered with protective elements 6 when they are not used, such that the entry of dirt and/or unwanted objects is prevented. Additionally, the benchtop 2 is arranged on a base 7.

Figure 2:
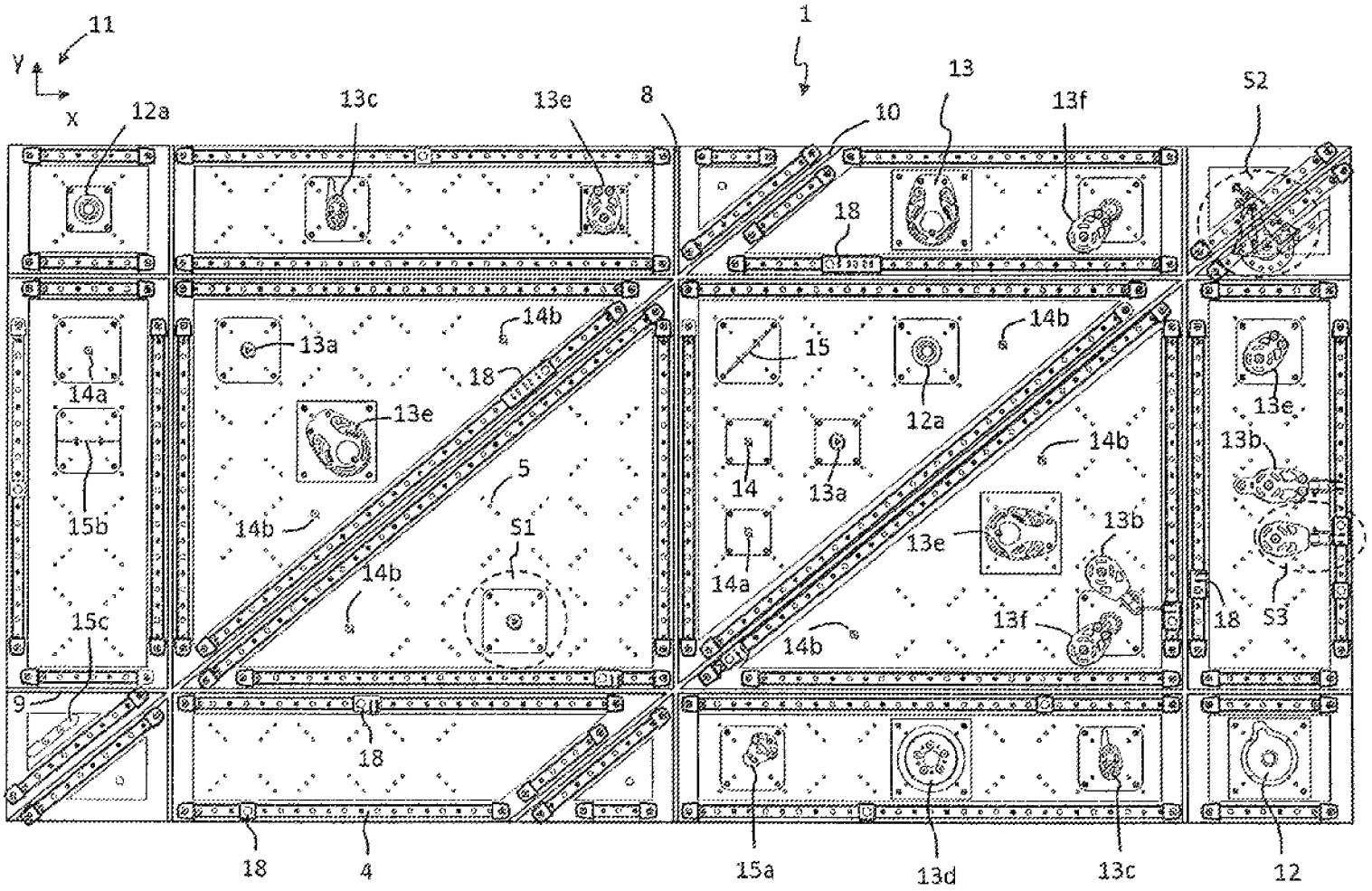
FIG. 2 shows a top view of a workbench for the cold intervention, folding, bending, twisting or deformation of metal sheets, according to an embodiment of the present invention, partially assembled.
Figure 2A:
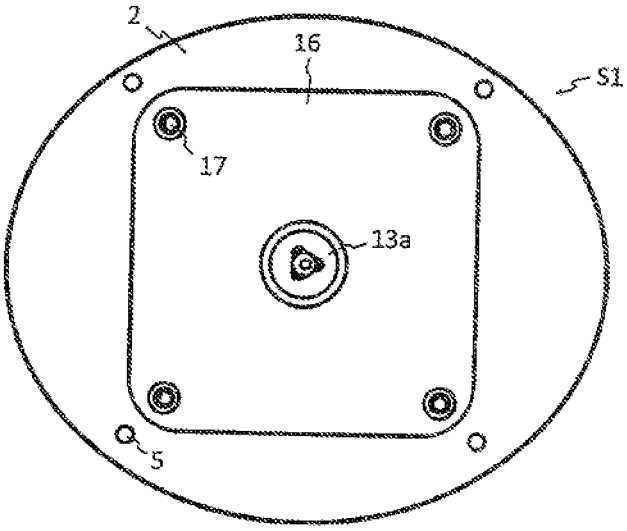
FIG. 2*a* shows an enlarged view of sector S1 of FIG. 2, according to an embodiment of the present invention.
Figure 2B:
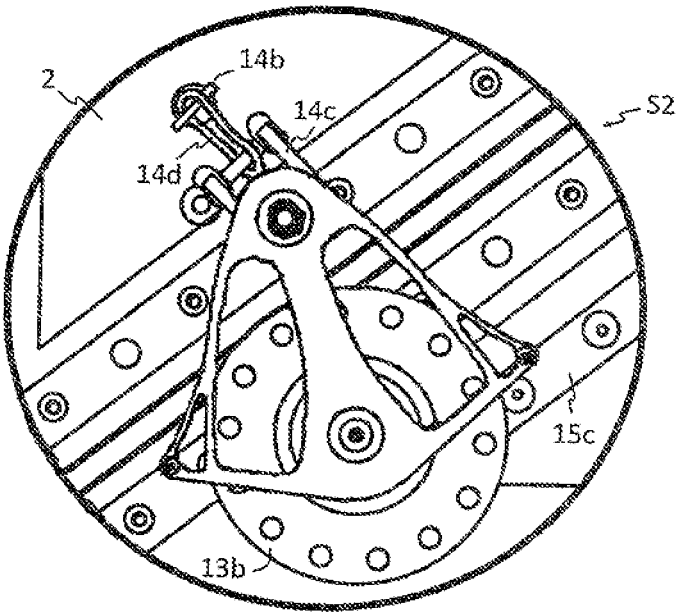
FIG. 2*b* shows an enlarged view of sector S2 of FIG. 2, according to an embodiment of the present invention.
Figure 2C:
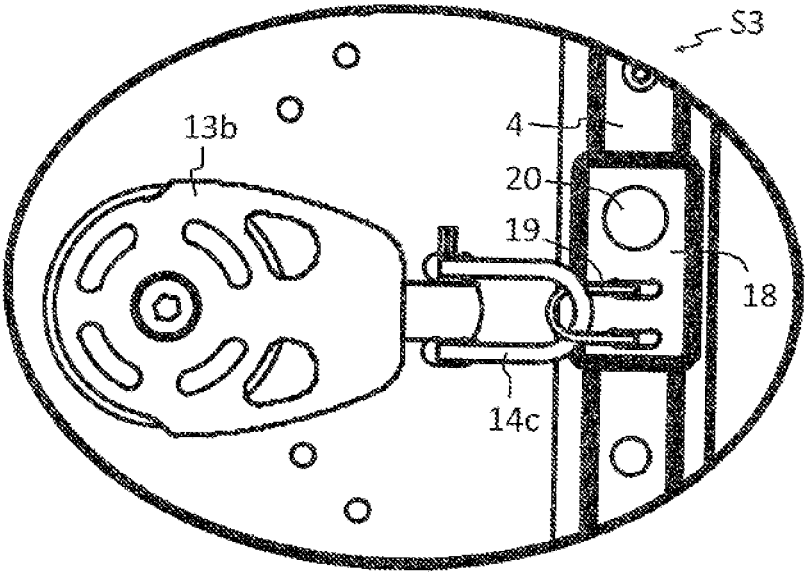
FIG. 2*c* shows an enlarged view of sector 33 of FIG. 2, according to an embodiment of the present invention.

In relation to FIG. 2, the channels of the plurality of channels 3 (FIG. 1) correspond to vertical channels 8, horizontal channels 9 and oblique channels 10; however, in other embodiments the channels of the plurality of channels 3 (FIG. 1) can be distributed in one or more directions, without this departing from the scope of the invention. Likewise, in this document the terms "vertical", "horizontal" or "oblique" must be understood in reference to the Cartesian plane 11 of this FIG. 2. Furthermore, the workbench 1 comprises tension adjustment means 12 for pulling or releasing a cord 22 (FIG. 3), where one of the ends of the cord 22 (FIG. 3) is coupled to said tension adjustment means 12. In this embodiment, the tension adjustment means 12 is a pinwheel with its respective lever. Likewise, the workbench 1 comprises force transmission means 13, through which the cord 22 passes (FIG. 3) to obtain a mechanical advantage, according to the tension applied to the cord 22 (FIG. 3) by the tension adjustment means 12. The force transmission means 13 comprise at least one of the group consisting of an open pulley 13*a*, a closed pulley 13*b*, a pulley with a clamp 13*c*, a sheave 13*d*, a fixed pulley block 13*e*, a pivoting pulley block 13*f* and a multiple pulley block 13*g* (FIG. 3). Additionally, the workbench 1 comprises coupling means 14 arranged on the benchtop 2 for coupling force transmission means 13 to the benchtop 2 or for diverting the path of the cord 22 (FIG. 3), wherein the coupling means 14 comprise at least one of the group consisting of an eye bolt 14*a*-14*b*, a shackle 14*c* (FIGS. 2*b*-2*c*), an automatic shackle (not shown in the drawings) and a snap hook 14*d* (FIG. 2*b*). On the other hand, cord securing means 15 are arranged on the benchtop 2 to prevent movement of the cord 22 (FIG. 3) after or while applying tension to said cord through the tension adjustment means 12, wherein the cord securing means 15 comprise at least one of the group consisting of a clamp, a swing clamp 15*a*, a fixed clamp (not shown in the drawings) and a cleat 15*b*-15*c*.

In this embodiment, the tension means 12, the force transmission means 13*a*, 13*c*-13*f*, the coupling means 14*a* and the cord securing means 15*a*, 15*b* are arranged on the benchtop 2 in an interchangeable manner. Therefore, to illustrate this feature, sector S1, which is enlarged in FIG. 2*a*, will be taken as reference, wherein each of said means arranged in an interchangeable manner (in this case, the force transmission means 13*a*) has a metal base 16 such that the holes 5 allow installing each metal base 16 on the benchtop 2 in a desired position through fixing elements 17 (for example, screws). Similarly, and now in reference to sector S2 of FIG. 2, which is enlarged in FIG. 2*b*, the coupling means 14*b* can also be arranged directly on the benchtop 2 using the holes 5 (FIG. 2). In FIG. 2*b*, an eye bolt 14*b* is arranged on the benchtop 2, where said eye bolt 14*b* is coupled to a snap hook 14*d* which is in turn coupled to a shackle 14*c* coupled to a closed pulley 13*b*. Likewise, a cleat 15*c* is also directly arranged on the benchtop 2 using the holes 5 (FIG. 2.

Still in relation to FIG. 2, each rail of the plurality of rails 4 arranged on the benchtop 2 is configured for receiving at least one carriage 18 that moves along said rail and allows the dynamic coupling of force transmission means 9, wherein each carriage 18 can be arranged in an interchangeable manner on the plurality of rails 4. This feature can be seen in sector S3, which is enlarged in FIG. 2*c*, wherein the carriage 18 can move along the rail 4 to a desired position; furthermore, the carriage 18 has an inner shackle 19 for coupling with a shackle 14*c* coupled to a closed pulley 13*b*, and a safety element 20 to prevent movement of the carriage 18 once the desired position is reached.

Finally, in relation to FIG. 2, alternatively to changing the position of the tension adjustment means 12 every time it is required, there is the possibility of arranging secondary tension adjustment means 12*a* on the benchtop 2, such that during a work process, two or more actuation points (positions) can be previously established and the change can be performed more quickly.

In relation to FIG. 3, one of the channels of the plurality of channels 3 receives the metal sheet 21, where the cord 22 acts on said metal sheet 21 through a power point 23 fixed thereon. Furthermore, an eye bolt 24 is placed on the power point 23 to allow actuating the cord 22, wherein said eye bolt 24 is coupled to a first terminal of a scale 25, whereas a second terminal of the scale 25 is coupled to a multiple pulley block 13*g* receiving stresses from a plurality of components in the workbench 1. The scale 25 thereby allows monitoring both the maximum power to which the sheet 21 is being subjected and the maximum power safety limits to which the components of the workbench 1 are subjected. The power point 23 can be observed in sector S'4, which corresponds to sector S4 before placement of the eye bolt 24. In this embodiment, the cord 22 is a rope-type cord.

Figure 4:
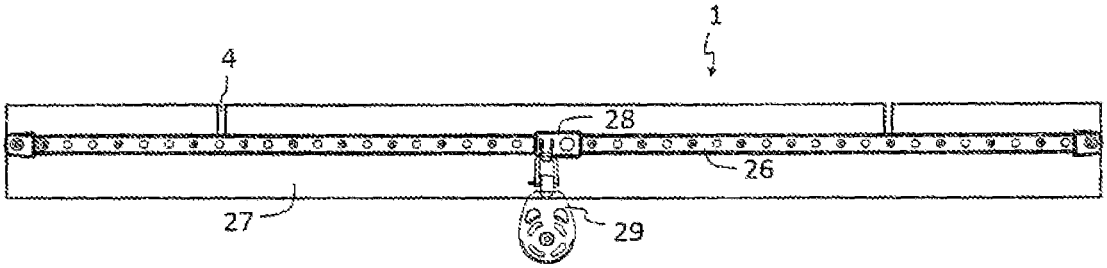
FIG. 4 shows a side view of one of the smaller sides of a workbench for the cold intervention, folding, bending, twisting or deformation of metal sheets, according to an embodiment of the present invention.
Figure 5:
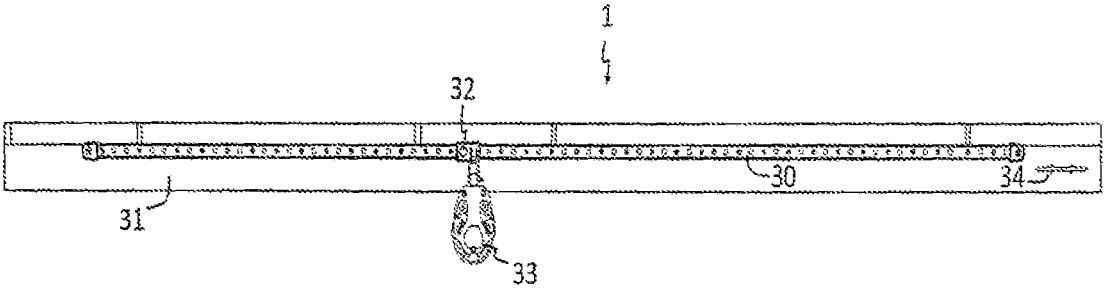
FIG. 5 shows a side view of one of the larger sides of a workbench for the cold intervention, folding, bending, twisting or deformation of metal sheets, according to an embodiment of the present invention.

In relation to FIG. 4, a first side rail 26 is arranged on the side surface of one of the smaller sides 27 of the workbench 1, where there is arranged on said first side rail 26 a first side carriage 28 for coupling a first side closed pulley 29. On the other hand, in relation to FIG. 5, a second aide rail 30 is arranged on the side surface of one of the larger sides 31 of the workbench 1, where there is arranged on said second side rail 30 a second side carriage 32 for coupling a second side closed pulley 33. Furthermore, a side cleat 34 is arranged on said side surface 31. These components allow broadening the actuation and power options of the metal plate 21 (FIG. 3).

It must be indicated that the channel of the plurality of channels 3 of the benchtop 2 for receiving the metal sheet 21, the force transmission means 13 and the position of the power point 23 fixed in the metal sheet 21 and of the tension adjustment means 12 on the benchtop 2 are selected according to an angle of actuation and/or a desired mechanical advantage.

Figure 6A:
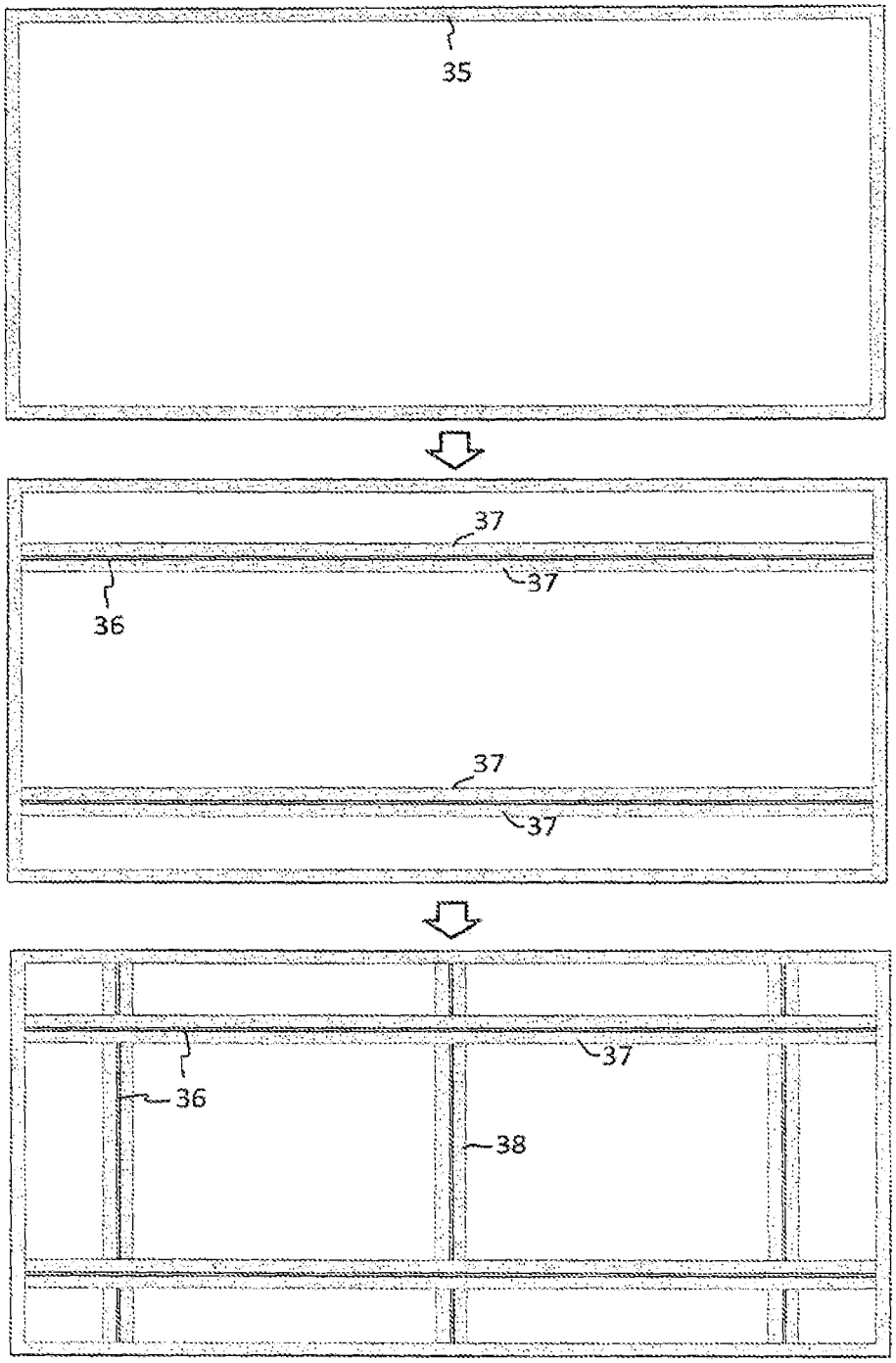
FIG. 6*a* shows a part of the process of manufacturing a workbench for the cold intervention, folding, bending, twisting or deformation of metal sheets, according to an embodiment of the present invention.
Figure 6B:
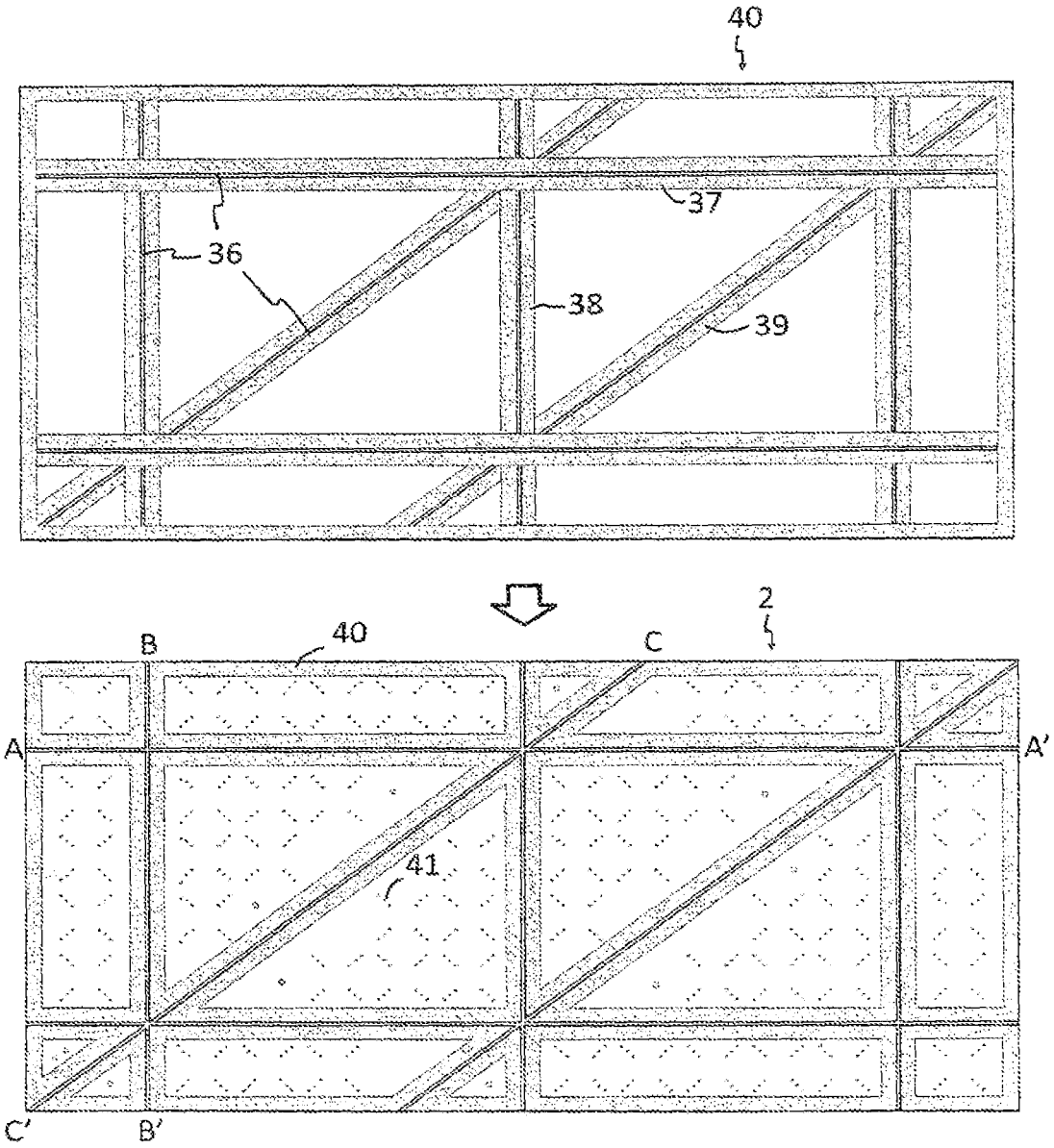
FIG. 6*b* shows the continuation of the process of manufacturing a workbench for the cold intervention, folding, bending, twisting or deformation of metal sheets shown in FIG. 6*a*, according to an embodiment of the present invention.

In terms of the method of manufacturing the workbench 1 for the cold intervention, folding, bending, twisting or deformation of metal sheets, said method comprises providing a box, with side walls and a lower base, made of a material suitable for making a formwork, the internal dimensions of which coincide with the external dimensions of the workbench 1 to be manufactured. Furthermore, and now in relation to FIGS. 6*a*-6*b*, the method comprises providing a perimetral metal frame 35 for the workbench 1 and coupling metal profiles to said frame 35 for forming a plurality of channels 36. In this embodiment, four horizontal profiles 37 are first placed, followed by eighteen vertical profiles 38. Finally, twelve oblique profiles 39 are placed such that a metal structure 40 is formed. Said metal structure 40 is placed inside the box (not shown in the drawings) such that the metal structure 40 is in contact with the lower base of the box; likewise, a mesh formed by metal rods (not shown in the drawings), having dimensions equal to or smaller than the internal dimensions of the box, is provided. The mesh is placed inside the box, on top of the metal structure 40, and concrete is poured into the box until reaching a desired level, to then leave the concrete to dry until it hardens, such that a benchtop 2 is formed. The benchtop 2 is removed from the box to then place it in a position in which the metal structure 40 is visible; the hardened concrete is then removed from the plurality of channels 36 of the benchtop and the channels are completed from end to end (A-A', B-B', C-C', etc.) by means of cutting the metal profiles. A plurality of holes 41 is subsequently made on the benchtop 2, and at least one rail (not shown in FIG. 6) is arranged on the benchtop 2 for placing at least one carriage configured for moving along the rail. Various alternatives for arranging the components (tension adjustment means, force transmission means, coupling means, and cord securing means) are therefore provided in the workbench 1, as described above.

In one of the embodiments, the formed metal structure 40 is made of crude iron at a 90° angle; the metal rods with which the mesh is formed are made of corrugated iron; and the box with which the formwork is made is made of pinewood.

Figure 7:
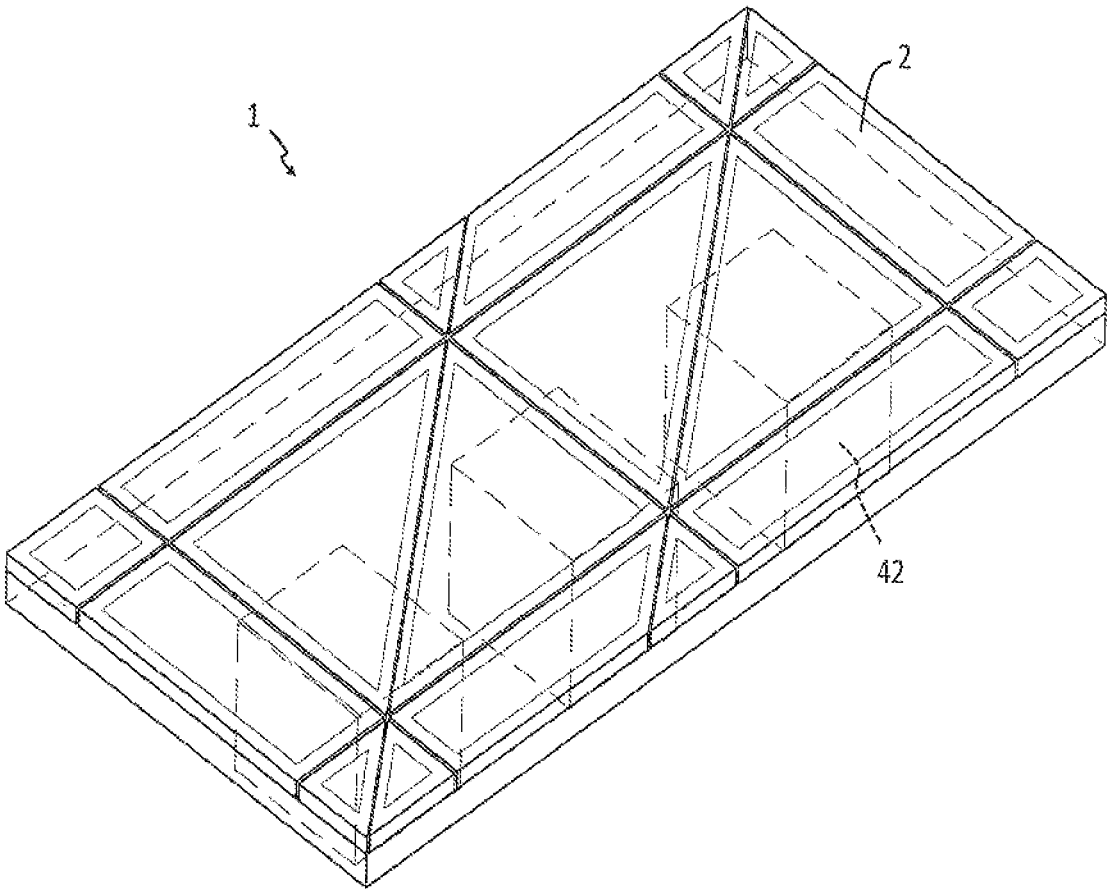
FIG. 7 shows an isometric view of the upper surface of a workbench for the cold intervention, folding, bending, twisting or deformation of metal sheets, according to an embodiment of the present invention, arranged on a base.

In relation to FIG. 7, the method of manufacturing also comprises providing a base for the bench 1. To that end, at least one box made of a material suitable for making a formwork (for example, pinewood) is provided, and concrete is poured into said at least one box until reaching a desired level, to then leave the concrete to dry until it hardens, such that three concrete blocks 42 are formed. Each formed concrete block 42 is then taken out of the respective box; the three concrete blocks 42 are placed in a linear arrangement, maintaining a distance between each block; and the benchtop 2 is placed on said blocks 42.

Finally, it must be indicated that in this document the terms metal "sheet" or "plate" must be understood as synonyms.

The invention claimed is:

1. A workbench (1) for the cold intervention, folding, bending, twisting or deformation of metal sheets, characterized in that it comprises:

a benchtop (2) with a plurality of channels (3) for receiving a metal sheet (21);

a cord (22) for acting on the metal sheet (21) through a power point (23) fixed in said metal sheet (21);

tension adjustment means (12) for pulling or releasing the cord (22), where one of the ends of the cord (22) is coupled to said tension adjustment means (12); force transmission means (13) through which the cord (22) passes to obtain a mechanical advantage, according to the tension applied on the cord (22) by the tension adjustment means (12);

wherein the tension adjustment means (12) and the force transmission means (13) are arranged on the benchtop (2); and wherein the channel of the plurality of channels (3) of the benchtop (2) for receiving the metal sheet (21), the force transmission means (13) and the position of the power point (23) fixed in the metal sheet (21) and of the tension adjustment means (12) on the benchtop (2) are selected according to an angle of actuation and/or a desired mechanical advantage.

2. The workbench (1) for the cold intervention, folding, bending, twisting or deformation of metal sheets according to claim 1, characterized in that the benchtop (2) with a plurality of channels (3) is a rectangular benchtop with vertical channels (8), horizontal channels (9) and oblique channels (10).

3. The workbench (1) for the cold intervention, folding, bending, twisting or deformation of metal sheets according to claim 1, characterized in that the benchtop (2) is arranged on a base (7).

4. The workbench (1) for the cold intervention, folding, bending, twisting or deformation of metal sheets according to claim 1, characterized in that it further comprises at least one rail (4) arranged on the benchtop (2), wherein each rail (4) is configured for receiving at least one carriage (18) that moves along said rail (4) and allows the dynamic coupling of force transmission means (13).

5. The workbench (1) for the cold intervention, folding, bending, twisting or deformation of metal sheets according to claim 1, characterized in that it further comprises a scale (25) arranged immediately before the power point (23) fixed in the metal sheet (21), such that it allows monitoring both the maximum power to which the sheet (21) is being subjected and the maximum power safety limits to which the components of the workbench (1) are subjected.

6. The workbench (1) for the cold intervention, folding, bending, twisting or deformation of metal sheets according to claim 1, characterized in that the tension adjustment means (12) are constituted by a pinwheel with its respective lever.

7. The workbench (1) for the cold intervention, folding, bending, twisting or deformation of metal sheets according to claim 1, characterized in that the force transmission means (13) comprise at least one of the group consisting of an open pulley (13*a*), a closed pulley (13*b*), a pulley with a clamp (13*c*), a sheave (13*d*), a fixed pulley block (13*e*), a pivoting pulley block (131) and a multiple pulley block (13*g*).

8. The workbench (1) for the cold intervention, folding, bending, twisting or deformation of metal sheets according to claim 1, characterized in that the tension adjustment means (12) and the force transmission means (13) are configured for being arranged in an interchangeable manner on the benchtop (2).

9. The workbench (1) for the cold intervention, folding, ben ng, twisting or deformation of metal sheets according to claim 4, characterized in that each carriage (18) is configured for being arranged in an interchangeable manner on said at least one rail (4).

10. The workbench (1) for the cold intervention, folding, bending, twisting or deformation of metal sheets according to claim 1, characterized in that it further comprises coupling means (14) arranged on the benchtop (2) for coupling force transmission means (13) to the benchtop or for diverting the path of the cord (22).

11. The workbench (1) for the cold intervention, folding, bending, twisting or deformation of metal sheets according to claim 10, characterized in that the coupling means (14) comprise at least one of the group consisting of an eye bolt (14*a*, 14*b*), a shackle (14*c*), an automatic shackle and a snap hook (14*d*).

12. The workbench (1) for the cold intervention, folding, bending, twisting or deformation of metal sheets according to claim 1, characterized in that it further comprises cord securing means (15) arranged on the benchtop (2) to prevent movement of the cord (22).

13. The workbench (1) for the cold intervention, folding, bending, twisting or deformation of metal sheets according to claim 12, characterized in that the cord securing means (15) comprise at least one of the group consisting of a clamp, a swing clamp (15*a*), a fixed clamp and a cleat (15*b*, 15*c*).

14. The workbench (1) for the cold intervention, folding, bending, twisting or deformation of metal sheets according to claim 10, characterized in that the coupling means (14) are configured for being arranged in an interchangeable manner on the benchtop (2).

15. The workbench (1) for the cold intervention, folding, bending, twisting or deformation of metal sheets according to claim 12, characterized in that the cord securing means (15) are configured for being arranged in an interchangeable manner on the benchtop (2).

16. The workbench (1) for the cold intervention, folding, bending, twisting or deformation of metal sheets according to claim 8, characterized in that the benchtop (2) has a plurality of holes (5) and each of the interchangeable means comprises a metal base (16), such that said holes (5) allow installing each metal base (16) on the benchtop (2) in a desired position through fixing elements (17).

17. The workbench (1) for the cold intervention folding, bending, twisting or deformation of metal sheets according to claim 1, characterized in that an eye bolt (24) is coupled to the power point (23) fixed in the metal sheet (21) to allow actuating the cord (22).

18. The workbench (1) for the cold intervention, folding, bending, twisting or deformation of metal sheets according to claim 1, characterized in that the cord (22) is a rope-type cord.

19. A method for the cold intervention, folding, bending, twisting or deformation of metal sheets, characterized in that it comprises the steps of:

selecting a channel of a benchtop (2) comprising a plurality of channels (3) for placing a metal sheet (21) according to a desired angle of actuation, where the benchtop (2) is part of a workbench (1);

placing the metal sheet (21) on the selected channel;

fixing a power point (23) on the metal sheet (21) according to a desired angle of actuation;

providing a cord (22) for acting on the metal sheet (21) through the fixed power point (23);

passing the cord (22) through force transmission means (13) suitably arranged on the benchtop (2) according to an angle of actuation and a desired mechanical advantage;

coupling one of the ends of the cord (22) to tension adjustment means (12) suitably arranged on the benchtop (2) according to an angle of actuation and a desired mechanical advantage; and applying tension to the cord (22) through said tension adjustment means (12) until achieving the desired result.

20. The method for the cold intervention, folding, bending, twisting or deformation of metal sheets according to claim 19, characterized in that the step of fixing a power point (23) on the metal sheet (21) comprises coupling an eye holt (24) to said power point to allow actuating the cord.

21. The method for the cold intervention, folding, bending, twisting or deformation of metal sheets according to claim 19, characterized in that the step of passing the cord (22) through force transmission means (13) suitably arranged on the benchtop (2) comprises:

selecting the force transmission means (13) to be used; and placing the force transmission means (13) in a specific position on the benchtop (2).

22. The method for the cold intervention, folding, bending, twisting or deformation of metal sheets according to claim 21, characterized in that the step of placing the force transmission means (13) in a specific position on the benchtop comprises at least one of the group consisting of:

coupling force transmission means (13) to the benchtop (2) through coupling means (14) arranged in a specific position on the benchtop (2);

coupling force transmission means (13) at least to a carriage (18) that moves along a rail (4) arranged on the benchtop (2), such that said at least one carriage (18) moves towards a specific position; and installing force transmission means (13) of the type comprising a metal base (16) in a specific position through a plurality of holes (5) on the benchtop (2) and fixing elements (17).

23. The method for the cold intervention, folding, bending, twisting or deformation of metal sheets according to claim 19, characterized in that the step of coupling one of the ends of the cord (22) to tension adjustment means (12) suitably arranged on the benchtop (2) comprises installing tension adjustment means (12) of the type comprising a metal base (16) in a specific position through a plurality of holes (5) on the benchtop (2) and fixing elements (17).

24. The method for the cold intervention, folding, bending, twisting or deformation of metal sheets according to claim 19, characterized in that it further comprises the step of preventing the movement of the cord through cord securing means (15) after or while applying tension to the cord (22) through the tension adjustment means (12).

25. The method for the cold intervention, folding, bending, twisting or deformation of metal sheets according to claim 19, characterized in that it further comprises the step of monitoring both the maximum power to which the sheet (21) is being subjected and the maximum power safety limits to which the components of the workbench (1) are subjected through a scale (25) arranged immediately before the power point (23).

26. A method of manufacturing a workbench for the cold intervention, folding, bending, twisting or deformation of metal sheets, characterized in that it comprises the steps of:

providing a box, with side walls and a lower base, made of a material suitable for making a formwork, the internal dimensions of which coincide with the external dimensions of the workbench (1) to be manufactured;

providing a perimetral metal frame (35) for the workbench (1) and coupling metal profiles (37, 38, 39) to said frame (35) for forming a plurality of channels (36), such that a metal structure (40) is formed;

placing the formed metal structure (40) inside the provided box, such that the metal structure (40) is in contact with the lower base of the box;

providing a mesh formed by metal rods, having dimensions equal to or smaller than the internal dimensions of the box;

placing the provided mesh inside the box, on top of the metal structure (40);

pouring concrete into the box until reaching a desired level, to then leave the concrete to dry until it hardens, such that a benchtop (2) is formed;

taking the benchtop (2) out of the box, to then place it in a position in which the metal structure (40) is visible;

removing the hardened concrete from the plurality of channels (36) of the benchtop (2) and completing the channels from end to end by means of cutting the metal profiles (37, 38, 39);

arranging tension adjustment means and force transmission means on the benchtop; and providing, a cord that works together with the tension adjustment means and the force transmission means to act on a metal sheet through a power point fixed in said metal sheet.

27. The method of manufacturing a workbench for the cold intervention, folding, bending, twisting or deformation of metal sheets according to claim 26, characterized in that it further comprises the steps of:

providing a base for the workbench (1); and placing the benchtop (2) on the base.

28. The method of manufacturing a workbench for the cold intervention, folding, bending, twisting or deformation of metal sheets according to claim 27, characterized in that the step of providing a base for the bench comprises the steps of:

providing at least one box made of a material suitable for making a formwork;

pouring concrete into said at least one box until reaching a desired level, to then leave the concrete to dry until it hardens, such that respective concrete blocks (42) are formed; and taking each formed concrete block (42) out of the respective box; and placing the concrete blocks (42), if there is more than one block, in a linear arrangement, maintaining a distance between each block (42).

29. The method of, manufacturing a workbench for the cold intervention, folding, bending, twisting or deformation of meal sheets according to claim 26, characterized in that the step of coupling metal profiles (37, 38, 39) to the perimetral metal frame (35) for forming a plurality of channels (36), such that a metal structure (40) is formed, comprises forming a rectangular structure with vertical channels, horizontal channels and oblique channels.

30. The method of manufacturing a workbench for the cold intervention, folding, bending, twisting or deformation of metal sheets according to claim 26, characterized in that the step of arranging force transmission means on the benchtop (2) comprises at least one of the group consisting of:

arranging coupling means in a specific position on the benchtop (2) and coupling force transmission means to the benchtop (2) through said coupling means;

arranging at least one rail on the benchtop (2), placing at least one carriage configured for moving along the rail and coupling force transmission means to said at least one carriage; and making a plurality of holes (41) on the benchtop (2) and installing force transmission means of the type comprising a metal base in a specific position through the plurality of holes (41) made of the benchtop (2) and fixing elements.

31. The method of manufacturing a workbench for the cold intervention, folding, bending, twisting or deformation of metal sheets according to claim 26, characterized in that the step of arranging tension adjustment means on the benchtop (2) comprises making a plurality of holes (41) on the benchtop (2) and installing tension adjustment means of the type comprising a metal base in a specific position through the plurality of holes (41) made on the benchtop and fixing elements.

32. The method of manufacturing a workbench for the cold intervention, folding, bending, twisting or deformation of metal sheets according to claim 26, characterized in that it further comprises the step of arranging cord securing means to prevent movement of the cord.

33. The method of manufacturing a workbench for the cold intervention, folding, bending, twisting or deformation of metal sheets according to claim 26, characterized in that it further comprises arranging a scale arranged immediately before the power point of the metal sheet for monitoring both the maximum power to which the sheet is being subjected and the maximum power safety limits to which the components of the workbench (1) are subjected.

34. The method of manufacturing a workbench for the cold intervention, folding bending, twisting or deformation of metal sheets according to claim 26, characterized in that the formed metal structure (40) is made of crude iron at a 90° angle.

35. The method of manufacturing a workbench for the cold intervention, folding, bending, tai fisting or deformation of metal sheets according to claim 26, characterized in that the metal rods with which the mesh is formed are made of corrugated iron.

36. The method of manufacturing a workbench for the cold intervention; folding, bending, twisting or deformation of metal sheets according to claim 26, characterized in that the box with which the formwork is made is made of pinewood.

* * * * *